US012736254B2

(12) United States Patent
Wang

(10) Patent No.: US 12,736,254 B2
(45) Date of Patent: Sep. 15, 2026

(54) HEATER AND HEATING POOL

(71) Applicant: ORIENTAL RECREATIONAL PRODUCTS (SHANGHAI) CO., LTD, Shanghai (CN)

(72) Inventor: Zhiyue Wang, Shanghai (CN)

(73) Assignee: Oriental Recreational Products (Shanghai) Co., Ltd, Shanghai (CN)

( * ) Notice: Subject to any disclaimer, the term of this patent is extended or adjusted under 35 U.S.C. 154(b) by 768 days.

(21) Appl. No.: 18/025,344

(22) PCT Filed: Nov. 19, 2021

(86) PCT No.: PCT/CN2021/131775
§ 371 (c)(1),
(2) Date: Mar. 8, 2023

(87) PCT Pub. No.: WO2022/063342
PCT Pub. Date: Mar. 31, 2022

(65) Prior Publication Data

US 2023/0324078 A1 Oct. 12, 2023

(30) Foreign Application Priority Data

Sep. 25, 2020 (CN) ..... 202022134496.5

(51) Int. Cl.
*F24H 1/54* (2022.01)
*F24H 1/10* (2022.01)

(52) U.S. Cl.
CPC ..... *F24H 1/54* (2022.01); *F24H 1/102* (2013.01); *F24H 2250/04* (2013.01)

(58) Field of Classification Search
CPC ..... F24H 1/0072; F24H 1/102; F24H 1/121; F24H 1/54; F24H 2250/04; F24H 9/1827;
(Continued)

(56) References Cited

U.S. PATENT DOCUMENTS

2007/0012251 A1* 1/2007 Zucker ..... H01L 21/67126 118/733
2011/0188839 A1* 8/2011 Trebouet ..... F24H 1/009 392/478

(Continued)

FOREIGN PATENT DOCUMENTS

CN 102338469 A 2/2012
CN 102970781 A 3/2013

(Continued)

OTHER PUBLICATIONS

"English translation of International Search Report of the China National Intellectual Property Administration", PCT International Application No. PCT/CN2021/131775 completed Jan. 14, 2022, mailed Jan. 26, 2020, Beijing China (3 pages).

*Primary Examiner* — Sang Y Paik
(74) *Attorney, Agent, or Firm* — Woods Oviatt Gilman LLP; Katherine H. McGuire, Esq.

(57) ABSTRACT

Provided herein is a heater and a heating pool. The heater comprises a heating core that includes a first surface and a second surface arranged on the opposite side of the heating core. A first insulating housing is placed on the first surface and forms a first heat insulating chamber together with the first surface. The second insulating housing is placed on the second surface and forms a second heat insulating chamber together with the second surface, wherein the first heat insulating chamber and the second heat insulating chamber communicate with each other. The heater of the utility model has good insulation performance and can prevent the occurrence of electrical leakage, so that the safety performance of the heater is improved.

16 Claims, 2 Drawing Sheets

(58) Field of Classification Search
CPC ..... H05B 2203/02; H05B 2203/021; H05B 3/04; H05B 3/06; H05B 3/141
USPC ..... 392/478
See application file for complete search history.

(56) References Cited

U.S. PATENT DOCUMENTS

| | | | | |
|---|---|---|---|---|
| 2016/0084523 | A1* | 3/2016 | Liu | F24H 9/146 392/486 |
| 2017/0223776 | A1* | 8/2017 | Xie | H05B 3/0004 |
| 2018/0031271 | A1* | 2/2018 | Huang | F24H 9/0021 |

FOREIGN PATENT DOCUMENTS

| | | | |
|---|---|---|---|
| CN | 103912989 | A | 7/2014 |
| CN | 213237949 | U | 5/2021 |
| DE | 102019204665 | A1 | 9/2020 |

* cited by examiner

HEATER AND HEATING POOL

TECHNICAL FIELD

The utility model relates to the technical field of heating, in particular to a heater and a heating pool.

BACKGROUND

Nowadays, recreational activities are popular with more and more people, and there are more and more products on the market. As an emerging recreational product, the massage pool has gradually entered people's daily life. With the increasing improvement in the quality of life, users have higher and higher functional requirements for the massage pool. Most of the existing massage pools use a PTC (Positive Temperature Coefficient) heater as its heating system. As heating in water is involved, no electrical leakage is allowed, otherwise there will be a safety hazard.

SUMMARY

An objective of the utility model is to improve safety performance of a heater. The utility model provides a heater and a heating pool.

In order to solve the above technical problems, an embodiment of the utility model discloses a heater, including: a heating core, including a first surface and a second surface arranged on two opposite sides of the heating core; a first insulating housing, placed on the first surface and forming a first heat insulating chamber together with the first surface; and a second insulating housing, placed on the second surface and forming a second heat insulating chamber together with the second surface. The first heat insulating chamber communicates with the second heat insulating chamber.

By adopting the above technical solution, when the heater is used to heat a fluid (for example, water), as water flows in the first heat insulating chamber and the second heat insulating chamber and thus is heated, the heater has good insulation performance and can prevent electrical leakage, so that the safety performance of the heater is improved.

According to another specific embodiment of the utility model, the heater further comprises an insulating layer. The insulating layer covers the heating core. The first insulating housing has an opening in a side facing the first surface, and the first surface serves as a bottom of the first heat insulating chamber, so that a fluid flowing into the first heat insulating chamber is capable of contacting the insulating layer on the first surface. The second insulating housing has an opening in a side facing the second surface, and the second surface serves as a bottom of the second heat insulating chamber, so that the fluid flowing into the second heat insulating chamber is capable of contacting the insulating layer on the second surface.

According to another specific embodiment of the utility model, the heating core extends along a length direction, and the first surface and the second surface are arranged on two opposite sides of the heating core in a thickness direction. The first surface is provided with a first pressing member and a second pressing member at an interval along the length direction, and the first insulating housing abuts against the first pressing member and the second pressing member respectively along the thickness direction; and/or the second surface is provided with a third pressing member and a fourth pressing member at an interval along the length direction, and the second insulating housing abuts against the third pressing member and the fourth pressing member respectively along the thickness direction.

According to another specific embodiment of the utility model, the first pressing member on the first surface has a first slope arranged at an acute angle with the first surface, and the second pressing member on the first surface has a second slope arranged at an acute angle with the first surface. A third slope parallel to and abutting against the first slope and a fourth slope parallel to and abutting against the second slope are arranged in the first insulating housing, and the third slope and the fourth slope of the first insulating housing are arranged between the first slope of the first pressing member and the second slope of the second pressing member along the length direction.

According to another specific embodiment of the utility model, the third pressing member on the second surface has a first slope arranged at an acute angle with the second surface, and the fourth pressing member on the second surface has a second slope arranged at an acute angle with the second surface. A third slope parallel to and abutting against the first slope and a fourth slope parallel to and abutting against the second slope are arranged in the second insulating housing, and the third slope and the fourth slope of the second insulating housing are arranged between the first slope of the third pressing member and the second slope of the fourth pressing member along the length direction.

According to another specific embodiment of the utility model, a first separating member is arranged in the first insulating housing, and the first separating member extends along the length direction and separates the first heat insulating chamber into relatively independent heat insulating chamber.

According to another specific embodiment of the utility model, the first insulating housing has a first inner wall and a second inner wall arranged oppositely along a width direction, and the first inner wall, the second inner wall and two ends of the first separating member in the length direction are respectively provided with the third slope and the fourth slope.

According to another specific embodiment of the utility model, a second separating member is arranged in the second insulating housing, and the second separating member extends along the length direction and separates the second heat insulating chamber into relatively independent heat insulating chamber.

According to another specific embodiment of the utility model, the second insulating housing has a first inner wall and a second inner wall arranged oppositely along the width direction, and the first inner wall, the second inner wall and two ends of the second separating member in the length direction are respectively provided with the third slope and the fourth slope.

According to another specific embodiment of the utility model, the heating core includes a PTC ceramic heating piece, electrode slices arranged on two opposite sides of the PTC ceramic heating piece, and an insulating layer covering the PTC ceramic heating piece and the electrode slices.

According to another specific embodiment of the utility model, the insulating layer comprises a polyimide film insulating layer.

According to another specific embodiment of the utility model, along the length direction of the heater, the first insulating housing has openings at two ends, the second insulating housing has openings at two ends, and the openings of the first insulating housing and the second insulating housing on the same side of the heater in the length direction communicate with each other through a pipe, so that the first heat insulating chamber communicates with the second heat insulating chamber.

This application further provides a heating pool comprising a heater as described in any of the above.

DETAILED DESCRIPTION

Figure 1:
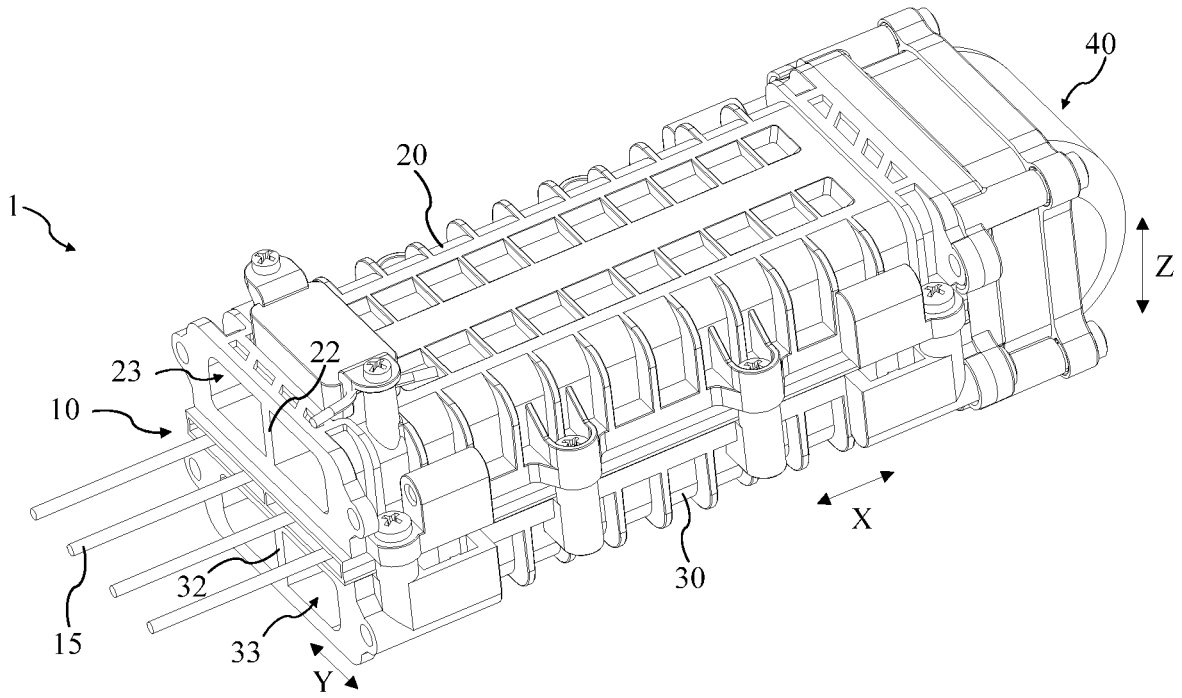
FIG. 1 illustrates a stereogram of a heater in accordance with an embodiment of the present utility model.

Implementations of the present utility model are described below with particular specific embodiments and other advantages and effects of the utility model will be readily apparent to those skilled in the art from the disclosure of this specification. Although the description of the present utility model will be introduced in conjunction with preferred embodiments, it is not intended that the features of the utility model are limited to the embodiments. On the contrary, the purpose of introducing the utility model in combination with the embodiments is to cover other options or modifications that may be extended based on the claims of the present utility model. In order to provide a deep understanding of the present utility model, many specific details will be included in the following description. The utility model may also be implemented without these details. Further some specific details will be omitted in the description in order to avoid confusing or obscuring the emphasis of the present utility model. It should be noted that the embodiments in the present utility model and the features in the embodiments can be combined with each other without conflict.

It should be noted that in this specification, similar reference numerals and letters indicate similar items in the following drawings, and therefore, once an item is defined in a drawing, it is not necessary to further define and explain it in the subsequent drawings.

In the description of the embodiments, it should be noted that an orientation or positional relationship indicated by the term "upper", "lower", "inner", "bottom" and the like is based on the orientation or positional relationship shown in the drawings, or the usual orientation or positional relationship of a product of the utility model when it is used, is only for the convenience of describing the utility model and simplifying the description, and does not indicate or imply that the apparatus or element referred to must have a specific orientation, be constructed and operate in a specific orientation, so it cannot be understood as a limitation to the utility model.

The terms "first" and "second", etc. are used only to distinguish descriptions and cannot be understood to indicate or imply relative importance.

In the description of the embodiments, it should also be noted that unless otherwise expressly specified and limited, the terms "arrangement" and "connection" should be understood in a broad sense, for example, the connection can be fixed connection, detachable connection, or integrated connection; can be mechanical connection or electrical connection; can be direct connection or indirect connection through an intermediate medium, and can be the internal communication of two elements. For those of ordinary skill in the art, the specific meaning of the above terms in the embodiments can be understood according to the specific situation.

In order to make the objectives, technical solutions and advantages of the present utility model clearer, the embodiments of the present utility model will be described in further detail below with reference to the accompanying drawings.

Referring to FIG. 1 to FIG. 4, the utility model provides a heater 1, including: a heating core 10, a first insulating housing 20 and a second insulating housing 30. The heating core 10 includes a first surface 11 and a second surface 12 arranged on two opposite sides of the heating core 10. In the embodiment, the first surface 11 and the second surface 12 are arranged on two opposite sides of the heating core 10 in a thickness direction (Z-direction in FIG. 1 to FIG. 3). The first insulating housing 20 is placed on the first surface 11 and forms a first heat insulating chamber 21 together with the first surface 11 of the heating core 10. The second insulating housing 30 is placed on the second surface 12 and forms a second heat insulating chamber 31 together with the second surface 12 of the heating core 10. The first heat insulating chamber 21 communicates with the second heat insulating chamber 31. The connection manner of the first insulating housing 20 and the second insulating housing 30 with the heating core 10 is not limited, and for example, the connection manner of the first insulating housing 20 and the second insulating housing 30 with the heating core 10 may be sealed connection through a bolt and a sealing ring.

In this application, the heater 1 uses the first insulating housing 20 and the second insulating housing 30, thereby forming the first heat insulating chamber 21 and the second heat insulating chamber 31. When the heater 1 is used to heat a fluid (for example, water), as water flows in the first heat insulating chamber 21 and the second heat insulating chamber 31 and thus is heated, the heater 1 has good insulation performance to realize isolation between water and electricity, which prevents electrical leakage, so that the safety performance of the heater 1 is improved.

It should be noted that materials of the first insulating housing 20 and the second insulating housing 30 are not limited, as long as electrical insulation can be realized. For example, in the embodiment, the first insulating housing 20 and the second insulating housing 30 are both plastic housing.

In some possible embodiments, with continued reference to FIG. 1 to FIG. 4, the heater 1 further includes an insulating layer 16. The insulating layer 16 covers the heating core 10, so that the heating core 10 is insulated, that is, the first surface 11 and the second surface 12 of the heating core 10 are both insulated. The insulating layer 16 is not limited by type, for example, in the embodiment, the insulating layer 16 may be a polyimide film insulating layer 16.

The first insulating housing 20 has an opening in a side facing the first surface 11, and the first surface 11 serves as a bottom of the first heat insulating chamber 21. That is, walls of the first insulating housing 20 and the first surface 11 of the heating core 10 together form the first heat insulating chamber 21. The second insulating housing 30 has an opening in a side facing the second surface 12, and the second surface 12 serves as a bottom of the second heat insulating chamber 31. That is, the walls of the second insulating housing 30 and the second surface 12 of the heating core 10 together form the second heat insulating chamber 31.

Since the first insulating housing 20 has the opening in the side facing the first surface 11, the second insulating housing 30 has the opening in the side facing the second surface 12, and the heating core 10 is insulated, the fluid flowing into the first heat insulating chamber 21 is capable of fully contacting the insulating layer 16 on the first surface 11, and the fluid flowing into the second heat insulating chamber 31 is capable of fully contacting the insulating layer 16 on the second surface 12, so that the heating efficiency of the fluid being heated in the heat insulating chambers is improved and the heat utilization rate is also high.

Figure 2:
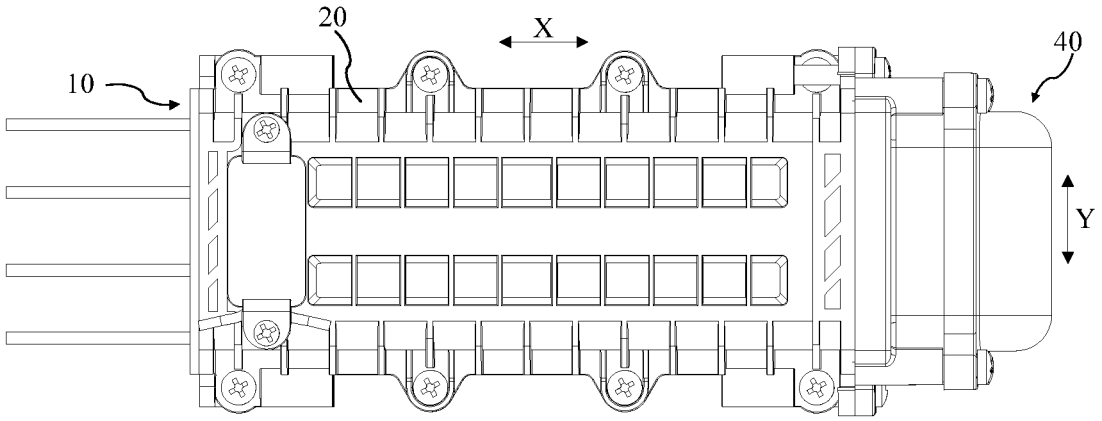
FIG. 2 illustrates a top view of the heater in accordance with an embodiment of the utility model.
Figure 3:
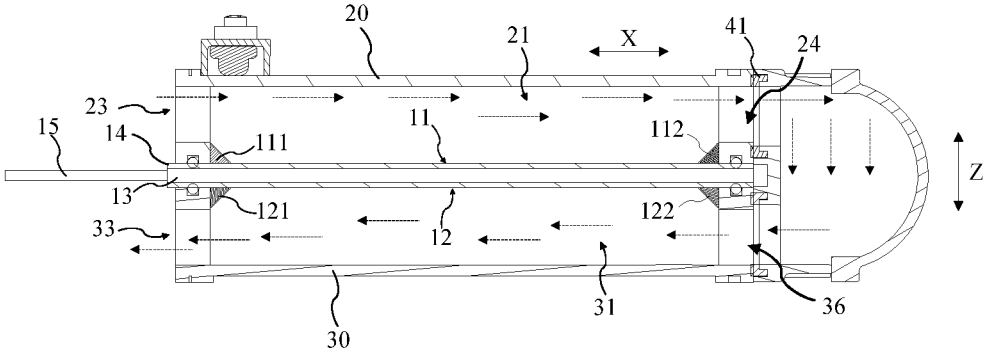
FIG. 3 illustrates a sectional view of the heater in accordance with an embodiment of the utility model.

In some possible embodiments, with continued reference to FIG. 1 to FIG. 4, the heating core 10 extends along a length direction (X-direction in FIG. 1 to FIG. 4), and the first surface 11 and the second surface 12 of the heating core 10 are arranged on two opposite sides of the heating core 10 in the thickness direction (Z-direction in FIG. 1 to FIG. 3). The first surface 11 of the heating core 10 is provided with a first pressing member 111 and a second pressing member 112 at an interval along the length direction, and the first insulating housing 20 abuts against the first pressing member 111 and the second pressing member 112 respectively along the thickness direction. Optionally, the first pressing member 111 and the second pressing member 112 respectively extend along a width direction (Y-direction in FIG. 1 and FIG. 2) of the heating core 10. After the first insulating housing 20 abuts against the first pressing member 111 and the second pressing member 112 respectively, the leakproofness of the first insulating housing 20 with the first pressing member 111 and the second pressing member 112 can be improved. For example, the first pressing member 111 and the second pressing member 112 are plastic pressing members.

In some possible embodiments, the second surface 12 is provided with a third pressing member 121 and a fourth pressing member 122 at an interval along the length direction, and the second insulating housing 30 abuts against the third pressing member 121 and the fourth pressing member 122 respectively along the thickness direction. Optionally, the third pressing member 121 and the fourth pressing member 122 respectively extend along the width direction (Y-direction in FIG. 1 and FIG. 2) of the heating core 10. After the second insulating housing 30 abuts against the third pressing member 121 and the fourth pressing member 122 respectively, the leakproofness of the second insulating housing 30 with the third pressing member 121 and the fourth pressing member 122 can be improved. For example, the third pressing member 121 and the fourth pressing member 122 are plastic pressing members.

In the embodiment, the first surface 11 is provided with the first pressing member 111 and the second pressing member 112, and the second surface 12 is provided with the third pressing member 121 and the fourth pressing member 122. In some possible embodiments, the first surface 11 is provided with the first pressing member 111 and the second pressing member 112, or the second surface 12 is provided with the third pressing member 121 and the fourth pressing member 122.

Figure 4:
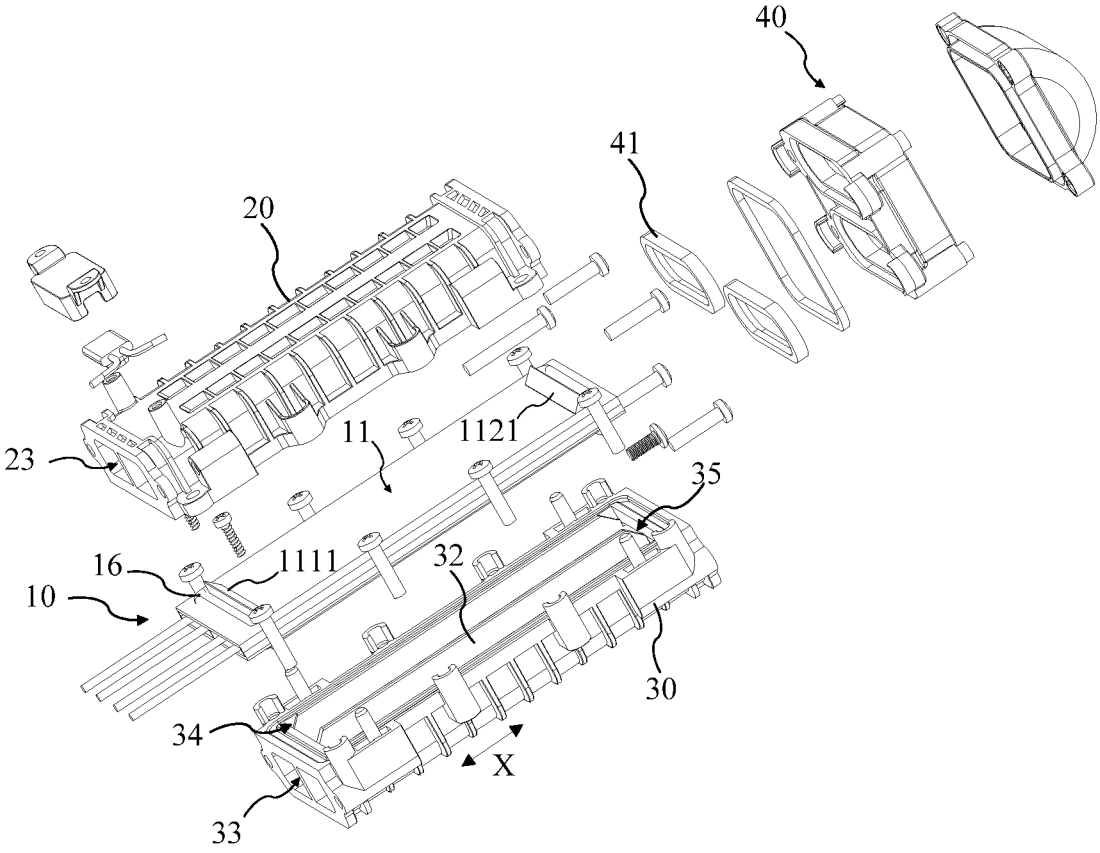
FIG. 4 illustrates a three-dimensional exploded view of the heater in accordance with an embodiment of the utility model.

As shown in FIG. 3 and FIG. 4, the first pressing member 111 on the first surface 11 has a first slope 1111 arranged at an acute angle with the first surface 11 (as shown in FIG. 3, a side surface of the first pressing member 111 is triangular), and the second pressing member 112 on the first surface 11 has a second slope 1121 arranged at an acute angle with the first surface 11 (as shown in FIG. 3, a side surface of the second pressing member 112 is triangular). A third slope (having the same structure as a third slope 34 of the second insulating housing 30) parallel to and abutting against the first slope 1111 and a fourth slope (having the same structure as a fourth slope 35 of the second insulating housing 30) parallel to and abutting against the second slope 1121 are arranged in the first insulating housing 20. Along the length direction, the third slope and the fourth slope of the first insulating housing 20 are arranged between the first slope 1111 of the first pressing member 111 and the second slope 1121 of the second pressing member 112.

On the one hand, the first insulating housing 20, when being mounted on the heating core 10, can serve as a mounting guide, thereby facilitating mounting. On the other hand, after the first insulating housing 20 is mounted on the heating core 10, the heating core 10 can limit the first insulating housing 20 in the length direction. Moreover, the first insulating housing 20 is in slope fit with the first pressing member 111 and the second pressing member 112, so that the contact area is increased, which better improves the leakproofness between the first insulating housing 20 and the heating core 10.

Similarly, the third pressing member 121 on the second surface 12 has a first slope arranged at an acute angle with the second surface 12 (as shown in FIG. 3, a side surface of the third pressing member 121 is triangular, and the first slope has the same structure as the first slope 1111 of the first insulating housing 20), and the fourth pressing member 122 on the second surface 12 has a second slope arranged at an acute angle with the second surface 12 (as shown in FIG. 3, a side surface of the fourth pressing member 122 is triangular, and the second slope has the same structure as the second slope 1121 of the first insulating housing 20). The third slope 34 parallel to and abutting against the first slope and the fourth slope 35 parallel to and abutting against the second slope are arranged in the second insulating housing 30. Along the length direction, the third slope 34 and the fourth slope 35 of the second insulating housing 30 are arranged between the first slope of the third pressing member 121 and the second slope of the fourth pressing member 122.

On the one hand, the second insulating housing 30, when being mounted on the heating core 10, can serve as a mounting guide, thereby facilitating mounting. On the other hand, after the second insulating housing 30 is mounted on the heating core 10, the heating core 10 can play the role of limiting the second insulating housing 30 in the length direction. Moreover, the second insulating housing 30 is in slope fit with the third pressing member 121 and the fourth pressing member 122, so that the contact area is increased, which better improves the leakproofness between the second insulating housing 30 and the heating core 10.

With continued reference to FIG. 1 and FIG. 4, a first separating member 22 is arranged in the first insulating housing 20, and the first separating member 22 extends along the length direction and separates the first heat insulating chamber 21 into relatively independent heat insulating chamber. As shown in FIG. 1 and FIG. 4, the number of the first separating member 22 is one, and accordingly, one first separating member 22 separates the first heat insulating chamber 21 into two relatively independent heat insulating chamber. However, the number of the first separating members 22 is not limited in the present application. In some possible embodiments, for example, the number of the first separating members 22 is two, three, etc.

The first insulating housing 20 has a first inner wall and a second inner wall arranged oppositely along the width direction, and the first inner wall, the second inner wall and two ends of the first separating member 22 in the length direction are respectively provided with the third slope and the fourth slope. That is, the two ends inside the first insulating housing 20 in the length direction are provided with the third slope and the fourth slope that are in slope fit with the first pressing member 111 and the second pressing member 112, which saves the space, and takes effects in the above three aspects.

With continued reference to FIG. 1 and FIG. 4, a second separating member 32 is arranged in the second insulating housing 30, and the second separating member 32 extends along the length direction and separates the second heat insulating chamber 31 into relatively independent heat insulating chamber. As shown in FIG. 1 and FIG. 4, the number of the second separating members 32 is one, and accordingly, one second separating member 32 separates the second heat insulating chamber 31 into two relatively independent heat insulating chamber. However, the number of the second separating member 32 is not limited in the present application. In some possible embodiments, for example, the number of the first separating members 22 is two, three, etc.

The second insulating housing 30 has a first inner wall and a second inner wall arranged oppositely along the width direction, and the first inner wall, the second inner wall and two ends of the second separating member 32 in the length direction are respectively provided with the third slope 34 and the fourth slope 35. That is, the two ends inside the second insulating housing 30 in the length direction are provided with the third slope 34 and the fourth slope 35 that are in slope fit with the third pressing member 121 and the fourth pressing member 122, which saves the space, and takes effects in the above three aspects.

In addition, the specific structure of the heating core 10 is not limited in the present application, as long as it is sufficient to achieve the heating of the fluid to be heated. Generally, the heating core 10 includes a PTC ceramic heating piece and electrode slices. The electrode slices are fixed to the PTC ceramic heating piece by bonding, welding or covering with an insulating film. With reference to FIG. 1, FIG. 3 and FIG. 4, in the embodiment, the heating core 10 includes a PTC ceramic heating piece 13, electrode slices 14 arranged on two opposite sides of the PTC ceramic heating piece 13, wires 15 and the insulating layer 16 covering the PTC ceramic heating piece and the electrode slices. When the heater 1 works, and the electrode slices are energized through the wires 15, the PTC ceramic heating piece generates heat to heat the fluid flowing into the first heat insulating chamber 21 and the second heat insulating chamber 31.

In addition, the type of the insulating layer 16 is not limited. For example, the insulating layer 16 may employ any one or more of the following materials: a polyimide film, an insulating ceramic sheet, a mica sheet, and other non-metal or semiconductor electrically-insulating and heat-conducting materials.

With continued reference to FIG. 1 to FIG. 4, along the length direction of the heater 1, the first insulating housing 20 has openings at two ends, including a first opening 23 and a second opening 24. The second insulating housing 30 has openings at two ends, including a third opening 33 and a fourth opening 36. The first opening 23 of the first insulating housing 20 and the third opening 33 of the second insulating housing 30 are arranged on the same side of the heater 1 in the length direction, and the second opening 24 of the first insulating housing 20 and the fourth opening 36 of the second insulating housing 30 are arranged on the same side of the heater 1 in the length direction.

In the embodiment, the second opening 24 of the first insulating housing 20 and the fourth opening 36 of the second insulating housing 30 on the same side of the heater 1 in the length direction communicate with each other through a pipe 40, so that the first heat insulating chamber 21 communicates with the second heat insulating chamber 31. The second opening 24 and the fourth opening 36 are each provided with a seal 41 at the connection with the pipe 40 to prevent water leakage. FIG. 3 shows a flow direction of the fluid to be heated in the first heat insulating chamber 21 and the second heat insulating chamber 31 of the heater 1. As shown in FIG. 3, the fluid to be heated flows from the first opening 23 of the first insulating housing 20 into the first heat insulating chamber 21, and flows into the second heat insulating chamber 31 through the pipe 40, and then flows out of the third opening 33 of the second insulating housing 30, thereby achieving that the fluid to be heated circulates in the heater 1 and thus is heated.

The present application further provides a heating pool, including the above any heater 1.

While the present utility model has been illustrated and described with reference to certain preferred embodiments of the utility model, it should be understood by those of ordinary skill in the art that the foregoing is a further detailed description of the utility model in connection with the particular embodiments and the particular practice of the utility model cannot be construed to be limited to these descriptions only. Those skilled in the art may make various changes in form and details including making several simple deductions or substitutions, without departing from the spirit and scope of the utility model.

What is claimed is:

1. A heater, characterized by comprising:

a heating core, comprising a first surface and a second surface arranged on two opposite sides of the heating core;

a first insulating housing, placed on the first surface and forming a first heat insulating chamber together with the first surface;

a second insulating housing, placed on the second surface and forming a second heat insulating chamber together with the second surface; wherein the first heat insulating chamber communicates with the second heat insulating chamber; and an insulating layer, wherein the insulating layer covers the heating core, wherein the first insulating housing has an opening in a side facing the first surface, and the first surface serves as a bottom of the first heat insulating chamber, so that a fluid flowing into the first heat insulating chamber is capable of contacting the insulating layer on the first surface, wherein the second insulating housing has an opening in a side facing the second surface, and the second surface serves as a bottom of the second heat insulating chamber, so that the fluid flowing into the second heat insulating chamber is capable of contacting the insulating layer on the second surface, wherein the heating core extends along a length direction, and the first surface and the second surface are arranged on two opposite sides of the heating core in a thickness direction, wherein the first surface is provided with a first pressing member and a second pressing member at an interval along the length direction, and the first insulating housing abuts against the first pressing member and the second pressing member respectively along the thickness direction, and/or wherein the second surface is provided with a third pressing member and a fourth pressing member at an interval along the length direction, and the second insulating housing abuts against the third pressing member and the fourth pressing member respectively along the thickness direction, and wherein the first pressing member on the first surface has a first slope arranged at an acute angle with the first surface, and the second pressing member on the first surface has a second slope arranged at an acute angle with the first surface; and an inner wall of the first insulating housing having arranged therein a third slope parallel to and abutting against the first slope and a fourth slope parallel to and abutting against the second slope, and the third slope and the fourth slope of the first insulating housing are arranged between the first slope of the first pressing member and the second slope of the second pressing member along the length direction.

2. The heater according to claim 1, characterized in that the third pressing member on the second surface has a first slope arranged at an acute angle with the second surface, and the fourth pressing member on the second surface has a second slope arranged at an acute angle with the second surface; and an inner wall of the first insulating housing having arranged therein a third slope parallel to and abutting against the first slope and a fourth slope parallel to and abutting against the second slope, and the third slope and the fourth slope of the second insulating housing are arranged between the first slope of the third pressing member and the second slope of the fourth pressing member along the length direction.

3. The heater according to claim 2, characterized in that the heating core comprises a Positive Temperature Coefficient (PTC) ceramic heating piece, electrode slices arranged on two opposite sides of the PTC ceramic heating piece, and an insulating layer covering the PTC ceramic heating piece and the electrode slices.

4. The heater according to claim 2, characterized in that along the length direction of the heater, the first insulating housing has openings at two ends, the second insulating housing has openings at two ends, and the openings of the first insulating housing and the second insulating housing on the same side of the heater in the length direction communicate with each other through a pipe, so that the first heat insulating chamber communicates with the second heat insulating chamber.

5. The heater according to claim 1, characterized in that a first separating member is arranged in the first insulating housing, and the first separating member extends along the length direction and separates the first heat insulating chamber into relatively independent heat insulating chamber.

6. The heater according to claim 5, characterized in that the first insulating housing has a first inner wall and a second inner wall arranged oppositely along a width direction, and the first inner wall, the second inner wall and two ends of the first separating member in the length direction are respectively provided with the third slope and the fourth slope.

7. The heater according to claim 5, characterized in that the heating core comprises a Positive Temperature Coefficient (PTC) ceramic heating piece, electrode slices arranged on two opposite sides of the PTC ceramic heating piece, and an insulating layer covering the PTC ceramic heating piece and the electrode slices.

8. The heater according to claim 5, characterized in that along the length direction of the heater, the first insulating housing has openings at two ends, the second insulating housing has openings at two ends, and the openings of the first insulating housing and the second insulating housing on the same side of the heater in the length direction communicate with each other through a pipe, so that the first heat insulating chamber communicates with the second heat insulating chamber.

9. The heater accordpg,22ing to claim 1, characterized in that a second separating member is arranged in the second insulating housing, and the second separating member extends along the length direction and separates the second heat insulating chamber into relatively independent heat insulating chamber.

10. The heater according to claim 9, characterized in that the second insulating housing has a first inner wall and a second inner wall arranged oppositely along a width direction, and the first inner wall, the second inner wall and two ends of the second separating member in the length direction are respectively provided with the third slope and the fourth slope.

11. The heater according to claim 9, characterized in that the heating core comprises a Positive Temperature Coefficient (PTC) ceramic heating piece, electrode slices arranged on two opposite sides of the PTC ceramic heating piece, and an insulating layer covering the PTC ceramic heating piece and the electrode slices.

12. The heater according to claim 9, characterized in that along the length direction of the heater, the first insulating housing has openings at two ends, the second insulating housing has openings at two ends, and the openings of the first insulating housing and the second insulating housing on the same side of the heater in the length direction communicate with each other through a pipe, so that the first heat insulating chamber communicates with the second heat insulating chamber.

13. The heater according to claim 1, characterized in that the heating core comprises a PTC ceramic heating piece, electrode slices arranged on two opposite sides of the PTC ceramic heating piece, and an insulating layer covering the PTC ceramic heating piece and the electrode slices.

14. The heater according to claim 13, characterized in that the insulating layer comprises a polyimide film insulating layer.

15. The heater according to claim 1, characterized in that along the length direction of the heater, the first insulating housing has openings at two ends, the second insulating housing has openings at two ends, and the openings of the first insulating housing and the second insulating housing on the same side of the heater in the length direction communicate with each other through a pipe, so that the first heat insulating chamber communicates with the second heat insulating chamber.

16. A heating pool, characterized by comprising the heater according claim 1.

* * * * *